US009068711B2

(12) United States Patent
Na et al.

(10) Patent No.: US 9,068,711 B2
(45) Date of Patent: Jun. 30, 2015

(54) HEADLAMP FOR VEHICLE WHICH PRODUCES GLARE-FREE HIGH BEAM

(71) Applicants: Hyundai Motor Company, Seoul (KR); Kia Motors Corp., Seoul (KR); SL Lighting Corporation, Daegu (KR)

(72) Inventors: Jin Ho Na, Suwon-si (KR); Young Ho Son, Gyeongsan-si (KR)

(73) Assignees: HYUNDAI MOTOR COMPANY, Seoul (KR); KIA MOTORS CORP., Seoul (KR); SL LIGHTING CORPORATION, Daegu (KR)

( * ) Notice: Subject to any disclaimer, the term of this patent is extended or adjusted under 35 U.S.C. 154(b) by 59 days.

(21) Appl. No.: 14/073,744

(22) Filed: Nov. 6, 2013

(65) Prior Publication Data

US 2015/0029740 A1 Jan. 29, 2015

(30) Foreign Application Priority Data

Jul. 24, 2013 (KR) ..... 10-2013-0087161

(51) Int. Cl.
*F21V 5/00* (2006.01)
*F21S 8/10* (2006.01)

(52) U.S. Cl.
CPC ..... *F21S 48/1225* (2013.01); *F21S 48/115* (2013.01)

(58) Field of Classification Search
CPC . F21S 48/115; F21S 48/1225; F21S 48/1736; F21S 48/1747
USPC ..... 362/507, 520–521, 538–539, 543–545
See application file for complete search history.

(56) References Cited

FOREIGN PATENT DOCUMENTS

| | | | |
|---|---|---|---|
| JP | 2003-322814 | A | 11/2003 |
| JP | 3659966 | B1 | 3/2005 |
| JP | 2009-218155 | A | 9/2009 |
| JP | 2012-68448 | A | 4/2012 |
| JP | 2012-199257 | A | 10/2012 |
| KR | 20-0135550 | Y1 | 5/1999 |

*Primary Examiner* — Jason Moon Han
(74) *Attorney, Agent, or Firm* — Morgan, Lewis & Bockius LLP

(57) ABSTRACT

A headlamp apparatus for a vehicle which produces a glare-free high beam may include a light source including a plurality of chips which may be arranged in line, and each of which may be separately turned on or off, a condenser lens disposed in front of the light source, and configured to improve light efficiency by condensing light emitted from the light source, a beam pattern conversion lens disposed in front of the condenser lens and configured to increase a size of a beam pattern of the light source in a vertical direction, and an optical refractive lens disposed in front of the beam pattern conversion lens, the optical refractive lens projecting the light that has passed through the beam pattern conversion lens onto a road by imaging the light onto a screen.

9 Claims, 4 Drawing Sheets

(section in height direction)

(section in lateral direction)

HEADLAMP FOR VEHICLE WHICH PRODUCES GLARE-FREE HIGH BEAM

The present application claims priority to Korean Patent Application No. 10-2013-0087161 filed Jul. 24, 2013, the entire contents of which is incorporated herein for all purposes by this reference.

BACKGROUND OF THE INVENTION

1. Field of the Invention

The present invention relates, in general, to a headlamp for a vehicle which produces a glare-free high beam, and, more particularly, to a headlamp for a vehicle which produces a glare-free high beam in which the clarity of a beam pattern can be improved by the use of a compound lens optical system and the upward field of vision can be improved by the increased height of the beam pattern.

2. Description of Related Art

In general, a headlamp provided in a vehicle is intended to provide a driver with a front field of vision, and is designed such that it can selectively produce a low beam and a high beam.

When there is an oncoming vehicle that is present ahead, the low beam is used in order not to obstruct the field of vision of the driver of the oncoming vehicle. The high beam is used in order to obtain clearer front field of vision when there are no vehicles ahead.

However, it is difficult for a driver to drive safely a vehicle when he/she uses the low beam and the high beam by repeatedly alternating between them during driving. In order to overcome this problem, the technology of glare-free high beam (GFHB), which can constantly produce a high beam without glare that distracts drivers of oncoming vehicles, was developed.

Referring to FIG. 1, in the related art, headlamps which produce glare-free high beams are provided with a rotary shield 3 between a light source 1 and a lamp cover 2, and produce an L-shaped beam pattern by adjusting the angle of rotation of the rotary shield 3. A beam pattern 5 from the left headlamp 4 and a beam pattern 7 from the right headlamp 6 are caused to overlap such that light from the light sources 1 is radiated to the left and right areas away from an oncoming vehicle 8.

Specifically, adjusting the angle of the rotary shield 3 causes the beam pattern 5 of the left headlamp 4 to be radiated to the left area of the oncoming vehicle 8 and the beam pattern 7 of the right headlamp 6 to be radiated on the right area of the oncoming vehicle 8 so that the light from the light sources 1 is not radiated toward the oncoming vehicle 8.

However, the headlamp which produces the glare-free high beam using the rotary shield 3 uses expensive components such as a motor which increases price and generates noise. In particular, since the clarity of the beam patterns 5 and 7 is reduced and the height of the beam patterns 5 and 7 in the vertical direction is small, it is difficult for the driver to have a front field of vision, which is problematic.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a headlamp for a vehicle which produces a glare-free high beam, in which the glare-free high beam can be produced using a compound lens optical system in order to reduce cost and noise, and in particular, improve the clarity of the beam pattern and improve the upward field of vision by increasing the height of the beam pattern.

In order to achieve the above object, according to one aspect of the present invention, there is provided a headlamp for a vehicle which produces a glare-free high beam. The headlamp may include a light source including a plurality of chips which are arranged in line, and each of which can be separately turned on or off, a condenser lens disposed in front of the light source, the condenser lens improving light efficiency by condensing light emitted from the light source, a beam pattern conversion lens disposed in front of the condenser lens, the beam pattern conversion lens increasing the size of a beam pattern of the light source in a vertical direction, and an optical refractive lens disposed in front of the beam pattern conversion lens, the optical refractive lens projecting the light that may have passed through the beam pattern conversion lens onto the road by imaging the light onto a screen.

The light source may include a plurality of light-emitting diode chips which are arranged in line in a horizontal direction.

The condensing lens may include a convex lens in which an emitting surface thereof may have a positive curvature.

The refractive index of an emitting surface of the condensing lens may be greater than the refractive index of an emitting surface of the optical refractive lens in order to increase light condensing efficiency, thereby improving the clarity of the beam pattern that is radiated onto the road.

The refractive index of the height-directional cross-section of an emitting surface of the condensing lens may be greater than the refractive index of the lateral cross-section of the emitting surface of the condensing lens.

The incidence surface and the emitting surface of the beam pattern conversion lens may have different refractive indices. The radius of curvature of the lateral cross-section of the incidence surface may be greater than the radius of curvature of the height-directional cross-section of the incidence surface in order to increase the size of the beam pattern of the light source in a vertical direction.

The incidence surface of the beam pattern conversion lens may have a negative curvature in order to prevent the light that has been condensed by the condenser lens from being reflected on the incidence surface and direct the light to enter in a vertical direction, thereby increasing the efficiency of incidence of the light.

The emitting surface of the beam pattern conversion lens may have a positive curvature in order to maximize light efficiency by minimizing a phenomenon in which the light that has been refracted by the incidence surface is trapped inside the beam pattern conversion lens by being totally internally reflected when the light strikes the emitting surface.

The optical refractive lens may have a convex lens. The emitting surface of the optical refractive lens may have a positive curvature, and the curvature of the emitting surface in a height direction may be identical with the curvature of the emitting surface in a lateral direction.

According to the present invention, a glare-free high beam is produced using a plurality of individual LED chips which can be controlled such that they are separately turned on or off as the light source and using multiple compound lenses, the height-directional cross-section and the lateral cross-section thereof having different refractive indices. It is therefore possible to significantly increase the clarity of a beam pattern in the glare-free high beam state that is radiated onto the road. In particular, the size of the beam pattern in the glare-free high beam state that is radiated onto the road can be significantly increased in the vertical direction. This consequently provides the advantage of a clearer and wider front field of vision to the driver so that the driver can drive safely.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
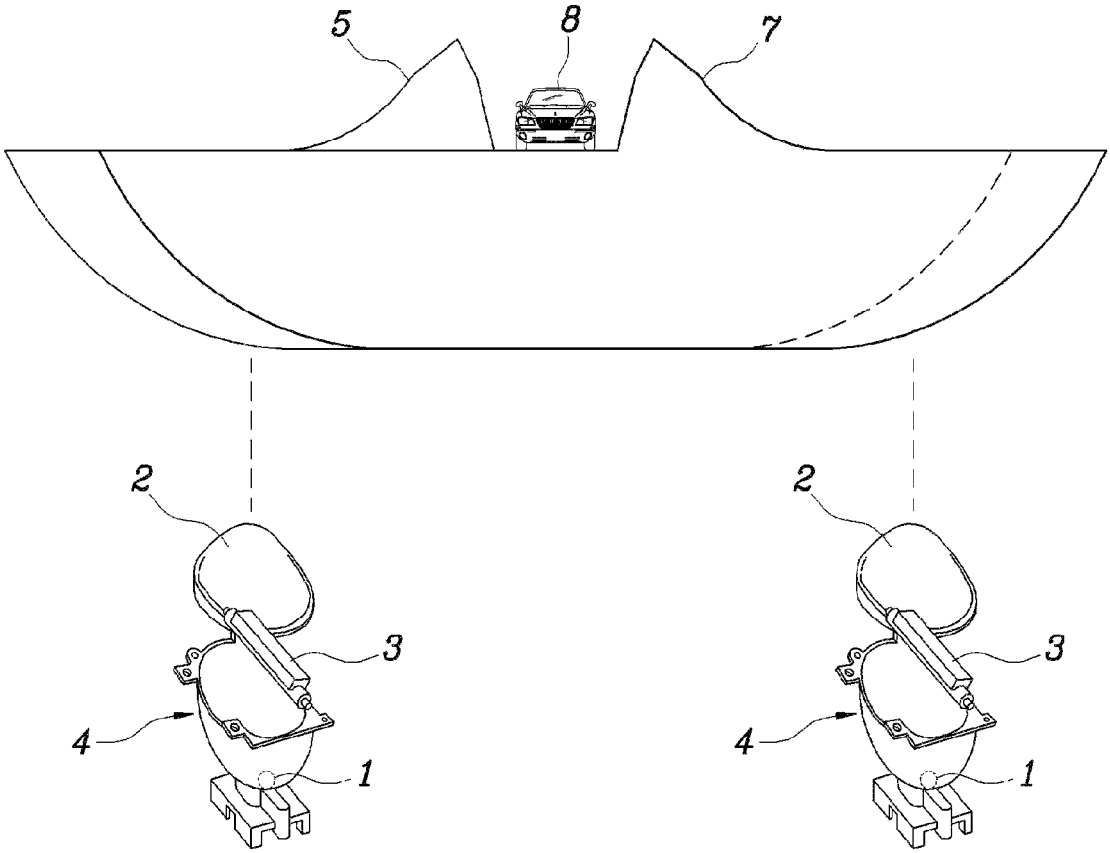
FIG. 1 (Related Art)
FIG. 1 is a view illustrating headlamps of the related art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinbelow, preferred embodiments of a headlamp for a vehicle which produces a glare-free high beam according to the present invention will be described in detail with reference to the accompanying drawings.

Figure 2:
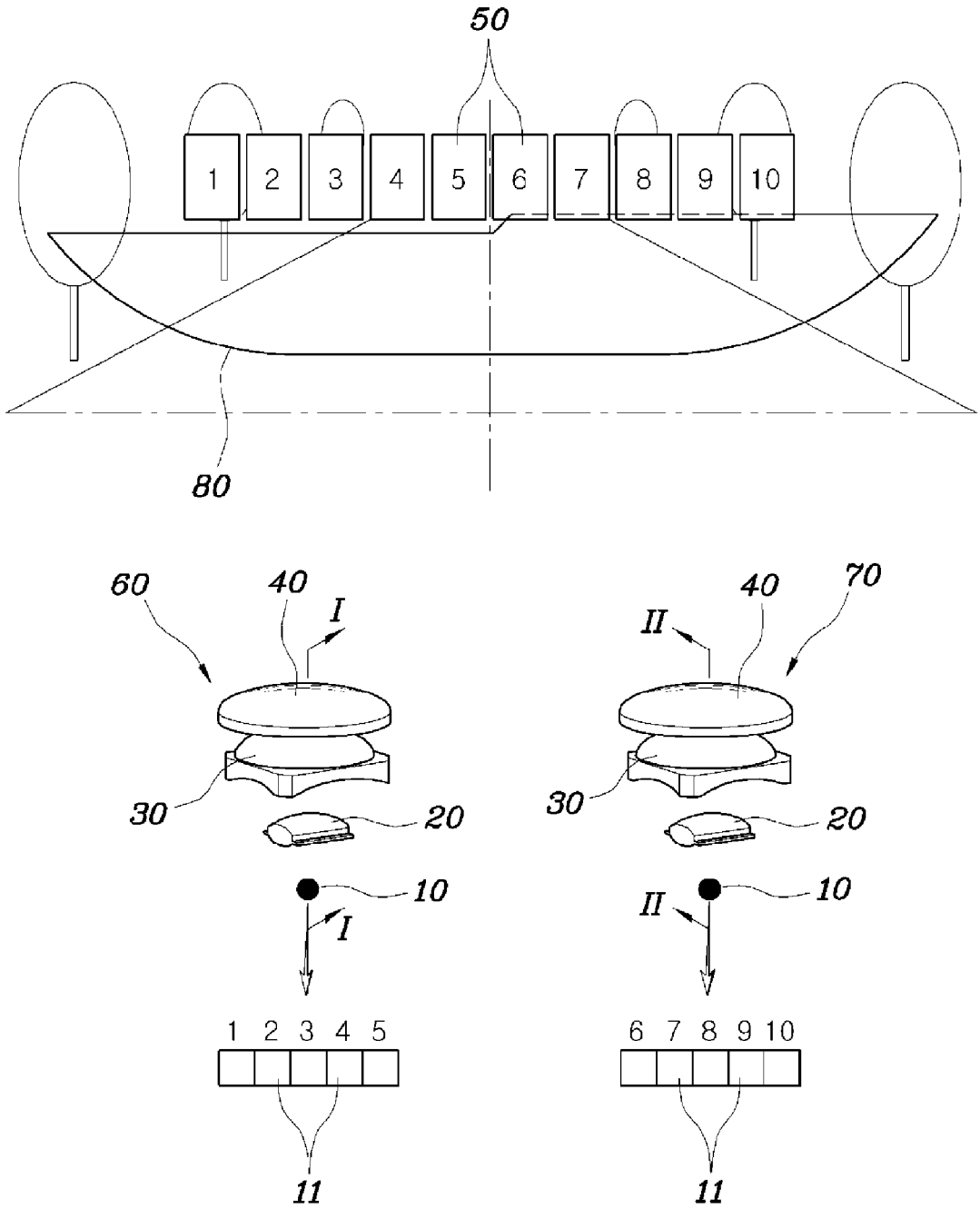
FIG. 2 is a view illustrating the state in which headlamps each having a compound lens optic system according to an exemplary embodiment of the present invention produce a glare-free high beam.
Figure 3:
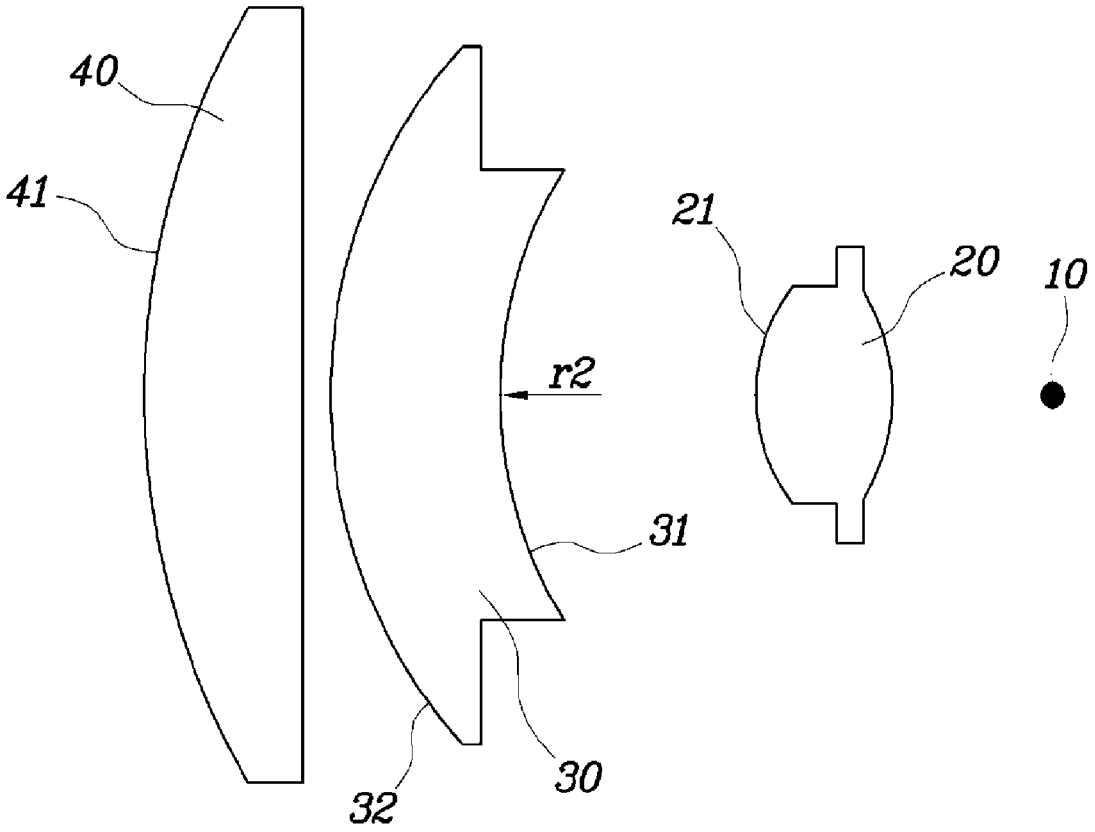
FIG. 3 is a cross-sectional view taken along line I-I in FIG. 2 in which the compound lens optic system is cut in the height direction.
Figure 4:
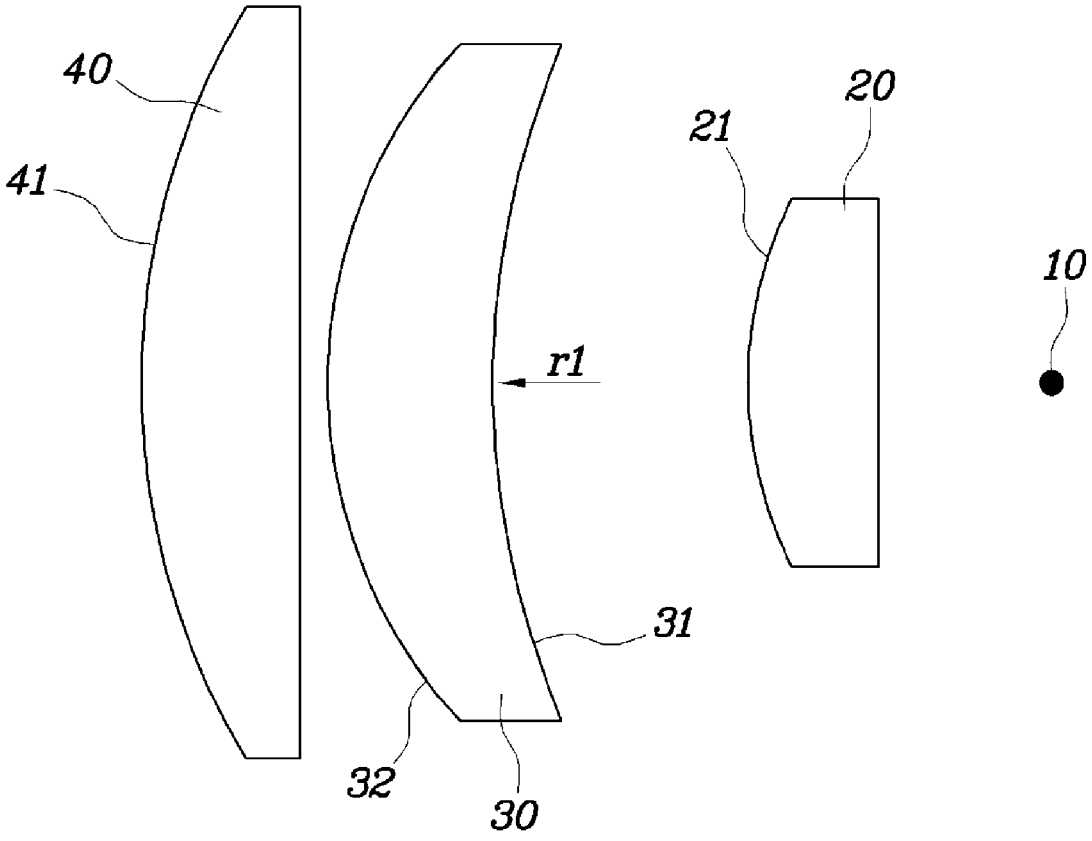
FIG. 4 is a cross-sectional view taken along line II-II in FIG. 2 in which the compound lens optic system is cut in the lateral direction.

Referring to FIG. 2 to FIG. 4, each of headlamps 60 and 70 according to an exemplary embodiment of the present invention includes a light source 10, a condenser lens 20, a beam pattern conversion lens 30 and an optical refractive lens 40. The light source 10 includes a plurality of chips 11 which are arranged in line, in which each of the chips 11 can be separately turned on or off. The condenser lens 20 is disposed in front of the light source 10, and improves light efficiency by condensing light emitted from the light source 10. The beam pattern conversion lens 30 is disposed in front of the condenser lens 20, and increases the size of the beam pattern of the light source 10 in the vertical direction. The optical refractive lens 40 is disposed in front of the beam pattern conversion lens 30, and projects the light that has passed through the beam pattern conversion lens 30 onto the road by imaging the light onto a screen.

That is, each of the left headlamp 60 and the right headlamp 70 has the light source 10, the condenser lens 20, the beam pattern conversion lens 30 and the optical refractive lens 40. The light source 10 includes a plurality of individual light-emitting diode (LED) chips 11 which are arranged in line in the horizontal direction.

The individual LED chips 11 are configured such that they are separately turned on or off by a controller.

When a driver operates the headlamps in a low beam mode, a beam pattern 80, or a low beam pattern, is radiated onto the road. When the driver operates the headlamp in a high beam mode, a beam pattern 50, the height of which is increased in the vertical direction, or a high beam pattern, is radiated onto the road.

When there is no oncoming vehicle ahead, the driver can operate the vehicle with a clearer field of vision by radiating the beam pattern 50 onto the road in the glare-free high beam state. When there is an oncoming vehicle ahead, the driver can prevent the driver of the oncoming vehicle from being distracted by glare by controlling the plurality of LED chips 11 such that the LED chips 11 are separately turned on or off.

The position, distance or the like of the oncoming vehicle is detected using a global positioning system (GPS) device and a sensor or the like provided in the vehicle. After the distance from the oncoming vehicle has been decreased to a certain distance, only certain LED chips 11, designated with numerals 4 and 5 from among the plurality of LED chips 11 which are illuminating the lane of the oncoming vehicle, are separately turned off in order to prevent the driver of the oncoming vehicle from being distracted by glare. At the same time, the remaining LED chips 11, except for those designated with numerals 4 and 5, are maintained in the turned-on state, such that the driver can continuously obtain a clear front field of vision.

The area of the beam pattern 50 can be controlled by adjusting the number of the LED chips 11.

It is preferred that the condenser lens 20 according to an exemplary embodiment of the present invention be implemented as a convex lens in which an emitting surface 21 thereof has a positive curvature.

In addition, it is preferred that the refractive index of the emitting surface 21 be greater than the refractive index of an emitting surface 41 of the optical refractive lens 40 in order to increase light condensing efficiency, thereby improving the clarity of the beam pattern 50 in the glare-free high beam state that is radiated onto the road.

In addition, it is preferred that the refractive index of the emitting surface 21 of the condenser lens 20 be greater in the height direction than in the lateral direction in order to increase the light condensing efficiency.

Herein, the height direction refers to the direction of the height of the condenser lens 20 or the headlamp when the headlamp is mounted to a vehicle, and the lateral direction refers to the lateral direction of the condenser lens 20 or the headlamp when the headlamp is mounted to a vehicle.

That is, the cross-section of the emitting surface 21 of the condenser lens 20 in the height direction is more convex than the cross-section of the emitting surface 21 of the condenser lens 20 in the lateral direction.

According to an exemplary embodiment of the present invention, in the beam pattern conversion lens 30, it is preferred that an incidence surface 31 and an emitting surface 32 have different refractive indices and the radius of curvature r1 of the incidence surface 31 in the lateral direction be greater than the radius of curvature r2 of the incidence surface 31 in the height direction in order to increase a size of the beam pattern of the light source 10 in a vertical direction.

In addition, it is preferred that the incidence surface 31 of the beam pattern conversion lens 30 has a negative curvature in order to prevent light that has been condensed by the condenser lens 20 from being reflected on the incidence surface 31 when the light strikes the incidence surface 31 and to direct the light to enter in the vertical direction, thereby increasing the efficiency of projection of the light.

In addition, it is preferred that the emitting surface 32 of the beam pattern conversion lens 30 has a positive curvature in order to maximize light efficiency by minimizing the phenomenon in which light that has been refracted by the incidence surface 31 is trapped inside the beam pattern conversion lens 30 by being totally internally reflected when it strikes the emitting surface 32.

In the individual LED chips 11 of the light source 10, a square pattern of light emitted from the chips 11 enters the beam pattern conversion lens 30 after having passed through the condenser lens 20. While the square pattern of light that has entered the beam pattern conversion lens 30 is passing through the beam pattern conversion lens 30, the square pattern of light is increased in height in the vertical direction and is converted into the beam pattern 50 that is in the glare-free high beam state. The resulting beam pattern 50 is emitted to the optical refractive lens 40.

The optical refractive lens 40 according to an exemplary embodiment of the present invention is a convex lens in which the emitting surface 41 thereof has a positive curvature. In the emitting surface 41, the curvature in the height direction is identical with the curvature in the lateral direction.

When a glare-free high beam is produced using the compound lens as described above, the condenser lens 20 in which the emitting surface 21 thereof has a large refractive index and the refractive index of the cross-section of the emitting surface 21 is greater in the height direction than in the lateral direction is used. This can significantly increase condensing efficiency, whereby the clarity of the beam pattern 50 in the glare-free high beam state that is radiated onto the road can be significantly increased. This consequently provides the advantage of a clearer front field of vision to the driver so that the driver can drive safely.

In addition, according to an exemplary embodiment of the present invention, the beam pattern conversion lens 30 in which the incidence surface 31 and the emitting surface 32 have different refractive indices and the radius of curvature r1 of the incidence surface 31 in the lateral direction is greater than the radius of curvature r2 of the incidence surface 31 in the height direction is used. This can significantly increase the size of the beam pattern 50 in the glare-free high beam state in the vertical direction, whereby the upward field of vision of the driver can be significantly increased. This consequently provides the advantage of a wider front field of vision to the driver so that the driver can drive safely.

Furthermore, according to an exemplary embodiment of the present invention, the plurality of individual LED chips 11 which are controlled such that they can be separately turned on or off is used as the light source 10. This configuration can constantly produce a glare-free high beam that does not distract a driver in an oncoming vehicle with glare, thereby advantageously increasing driving safety.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A headlamp apparatus for a vehicle which produces a glare-free high beam comprising:

a light source including a plurality of chips which are arranged in line, and each of which is separately turned on or off;

a condenser lens disposed in front of the light source, and configured to improve light efficiency by condensing light emitted from the light source;

a beam pattern conversion lens disposed in front of the condenser lens and configured to increase a size of a beam pattern of the light source in a vertical direction; and an optical refractive lens disposed in front of the beam pattern conversion lens, the optical refractive lens projecting the light that has passed through the beam pattern conversion lens onto a road by imaging the light onto a screen.

2. The headlamp apparatus according to claim 1, wherein the light source comprises a plurality of light-emitting diode chips which are arranged in line in a horizontal direction.

3. The headlamp apparatus according to claim 1, wherein the condensing lens comprises a convex lens in which an emitting surface thereof has a positive curvature.

4. The headlamp apparatus according to claim 1, wherein a refractive index of an emitting surface of the condensing lens is greater than a refractive index of an emitting surface of the optical refractive lens in order to increase light condensing efficiency, thereby improving clarity of the beam pattern that is radiated onto the road.

5. The headlamp apparatus according to claim 1, wherein a refractive index of a height-directional cross-section of an emitting surface of the condensing lens is greater than a refractive index of a lateral cross-section of the emitting surface of the condensing lens.

6. The headlamp apparatus according to claim 1, wherein an incidence surface and an emitting surface of the beam pattern conversion lens have different refractive indices, and wherein a radius of curvature of a lateral cross-section of the incidence surface is greater than a radius of curvature of a height-directional cross-section of the incidence surface in order to increase a size of the beam pattern of the light source in a vertical direction.

7. The headlamp apparatus according to claim 6, wherein the incidence surface of the beam pattern conversion lens has a negative curvature in order to prevent the light that has been condensed by the condenser lens from being reflected on the incidence surface and direct the light to enter in a vertical direction, thereby increasing an efficiency of incidence of the light.

8. The headlamp apparatus according to claim 6, wherein the emitting surface of the beam pattern conversion lens has a positive curvature in order to maximize light efficiency by minimizing a phenomenon in which the light that has been refracted by the incidence surface is trapped inside the beam pattern conversion lens by being totally internally reflected when the light strikes the emitting surface.

9. The headlamp apparatus according to claim 6, wherein the optical refractive lens comprises a convex lens, and wherein an emitting surface of the optical refractive lens has a positive curvature, and a curvature of the emitting surface in a height direction is identical with a curvature of the emitting surface in a lateral direction.

* * * * *